US009829158B2

(12) United States Patent
Gerlach et al.

(10) Patent No.: US 9,829,158 B2
(45) Date of Patent: Nov. 28, 2017

(54) LAMP

(71) Applicant: OSRAM GmbH, Munich (DE)

(72) Inventors: Berthold Gerlach, Giengen (DE); Jozsef Szekely, Weissenhorn (DE); Oliver Woisetschlaeger, Sontheim (DE); Sven Seifritz, Herbrechtingen (DE); Tobias Kohler, Neresheim (DE); Peter Niedermeier, Munich (DE); Dirk Amsbeck, Berlin (DE)

(73) Assignee: OSRAM GmbH, Munich (DE)

( * ) Notice: Subject to any disclaimer, the term of this patent is extended or adjusted under 35 U.S.C. 154(b) by 243 days.

(21) Appl. No.: 14/633,178

(22) Filed: Feb. 27, 2015

(65) Prior Publication Data

US 2015/0247606 A1 Sep. 3, 2015

(30) Foreign Application Priority Data

Feb. 28, 2014 (DE) ..... 20 2014 001 946 U

(51) Int. Cl.

| | |
|---|---|
| ***F21K 99/00*** | (2016.01) |
| ***F21S 8/10*** | (2006.01) |
| ***F21V 29/70*** | (2015.01) |
| ***F21V 23/00*** | (2015.01) |
| ***F21K 9/232*** | (2016.01) |
| *F21V 29/76* | (2015.01) |
| *F21Y 115/10* | (2016.01) |

(52) U.S. Cl.

CPC ..... *F21K 9/135* (2013.01); *F21K 9/232* (2016.08); *F21S 48/212* (2013.01); *F21S 48/215* (2013.01); *F21S 48/321* (2013.01); *F21S 48/328* (2013.01); *F21V 23/001* (2013.01); *F21V 29/70* (2015.01); *F21V 29/767* (2015.01); *F21Y 2115/10* (2016.08)

(58) Field of Classification Search

CPC ..... F21K 9/135; F21K 9/232; F21V 29/70; F21V 23/001; F21V 29/767; F21S 48/212; F21S 48/215; F21S 48/321; F21S 48/328; F21Y 2115/10

See application file for complete search history.

(56) References Cited

U.S. PATENT DOCUMENTS

| | | | | |
|---|---|---|---|---|
| 4,211,955 | A | 7/1980 | Ray | |
| 8,523,410 | B2 * | 9/2013 | Hashimoto | F21V 3/0436 362/294 |
| 9,016,924 | B2 * | 4/2015 | Betsuda | F21K 9/135 362/235 |
| 9,222,625 | B2 * | 12/2015 | Horio | H01L 25/0753 |
| 2012/0243232 | A1 * | 9/2012 | Bertram | F21K 9/00 362/249.02 |
| 2015/0211723 | A1 * | 7/2015 | Athalye | F21V 29/77 362/294 |

* cited by examiner

*Primary Examiner* — Bao Q Truong

(74) *Attorney, Agent, or Firm* — Viering, Jentschura & Partner mbB

(57) ABSTRACT

In various embodiments, a lamp is provided. The lamp may include a mounting board; at least one semiconductor light source arrangement arranged on the mounting board and comprising a base, which is provided with base contacts for supplying energy to the at least one semiconductor light source arrangement and which is compatible with a standardized incandescent lamp base; and at least one insulation displacement contact to make electrical contact with the at least one semiconductor light source arrangement.

8 Claims, 4 Drawing Sheets

LAMP

CROSS-REFERENCE TO RELATED APPLICATION

This application claims priority to German Patent Application Serial No. 20 2014 001 946.0, which was filed Feb. 28, 2014, and is incorporated herein by reference in its entirety.

TECHNICAL FIELD

Various embodiments relate generally to a lamp.

BACKGROUND

Such a lamp is disclosed, for example, in the patent specification U.S. Pat. No. 4,211,955. Said specification describes a lamp which has at least one light-emitting diode as light source and is equipped with a base, which is compatible with a standardized incandescent lamp base. Electrical components of an operating circuit for the at least one light-emitting diode are accommodated in the base.

SUMMARY

In various embodiments, a lamp is provided. The lamp may include a mounting board; at least one semiconductor light source arrangement arranged on the mounting board and comprising a base, which is provided with base contacts for supplying energy to the at least one semiconductor light source arrangement and which is compatible with a standardized incandescent lamp base; and at least one insulation displacement contact to make electrical contact with the at least one semiconductor light source arrangement.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DESCRIPTION

Figure 1:
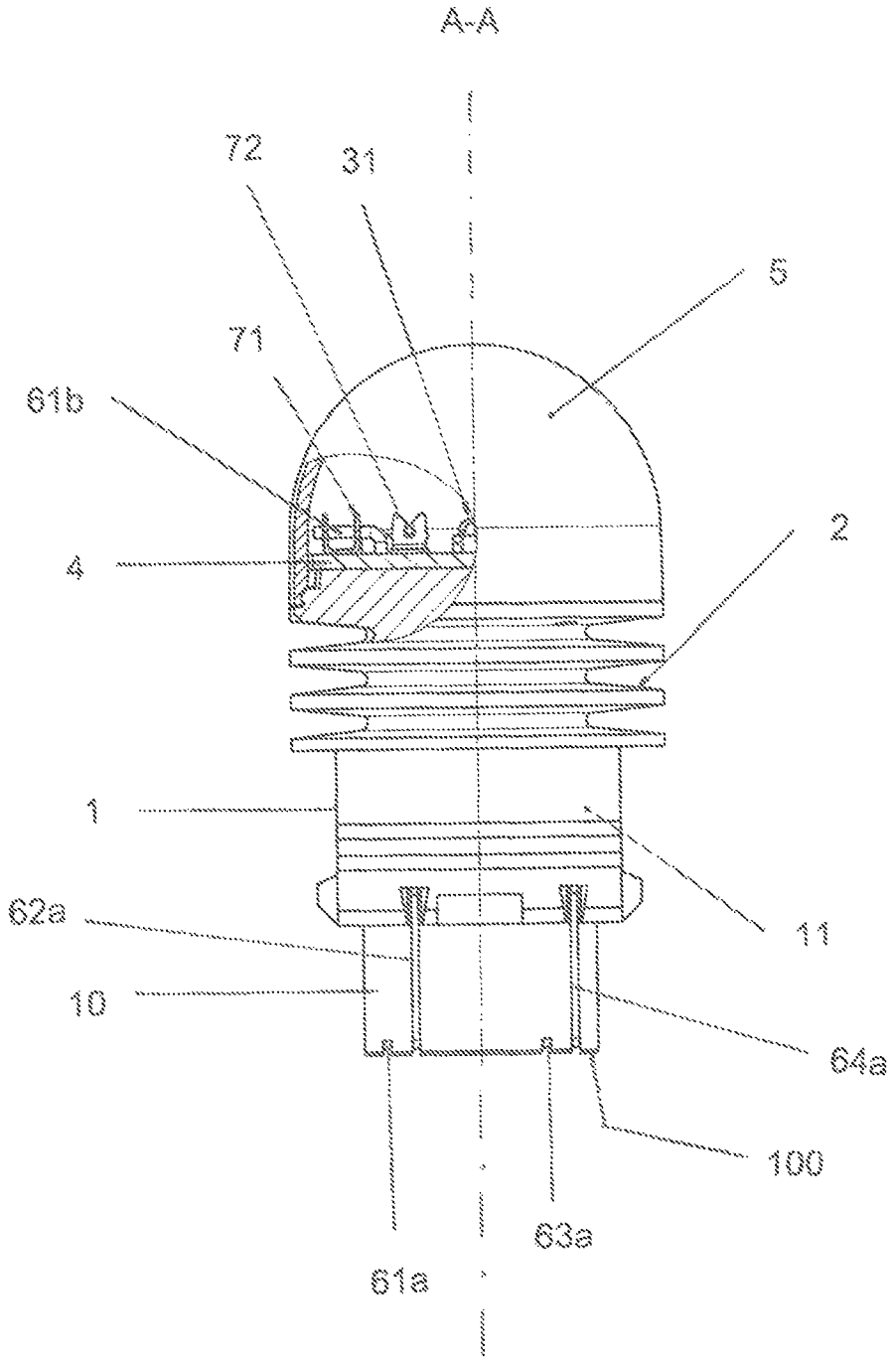
FIG. 1 shows a partially sectioned illustration of a lamp in accordance with various embodiments.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

The word "over" used with regards to a deposited material formed "over" a side or surface, may be used herein to mean that the deposited material may be formed "directly on", e.g. in direct contact with, the implied side or surface. The word "over" used with regards to a deposited material formed "over" a side or surface, may be used herein to mean that the deposited material may be formed "indirectly on" the implied side or surface with one or more additional layers being arranged between the implied side or surface and the deposited material.

Various embodiments provide a lamp which is usable as a replacement for an incandescent lamp in a corresponding lampholder and enables a simplified construction.

The lamp according to various embodiments has at least one semiconductor light source arrangement, which is arranged on a mounting board, and a base, which is provided with electrical base contacts for supplying energy to the at least one semiconductor light source arrangement and which is compatible with a standardized incandescent lamp base. In accordance with various embodiments, the lamp has at least one insulation displacement contact for making electrical contact with the at least one semiconductor light source arrangement.

As a result, the electrical contact-making with the at least one semiconductor light source arrangement on the mounting board is simplified. In various embodiments, it is possible to dispense with a connection by soldering. The insulation displacement contact-making can be produced more easily and is more reliable than soldering of the electrical contacts.

In various embodiments, the at least one insulation displacement contact is arranged on the mounting board in order to produce an electrical connection between the semiconductor light source arrangement arranged on the mounting board and a base contact.

In various embodiments, at least one base contact of the lamp is connected to the at least one insulation displacement contact by a power supply wire in order to ensure simple contact-making.

In accordance with an embodiment, a first end of the power supply wire forms the base contact, and contact is made with the second end of the power supply wire by the insulation displacement contact on the mounting board.

In accordance with various embodiments, the at least one insulation displacement contact is in the form of a self-tapping metal screw or an electrically conductive rivet. As a result, an electrical contact area on the mounting board can be electrically conductively connected to a base contact in a simple manner. For this purpose, the self-tapping screw or the electrically conductive rivet may protrude through the mounting board into a heat sink, which consists of an electrically conductive and thermally conductive material and is electrically connected for its part to a base contact of the lamp.

The mounting board of the lamp according to various embodiments may rest on a heat sink in order to be able to dissipate the heat generated by the at least one semiconductor light source arrangement and the operating device thereof to the surrounding environment. The heat sink may be fixed on the base. As a result, in addition the base can be used for heat dissipation.

The base and the heat sink of the lamp according to various embodiments may have leadthroughs for at least one power supply wire in order to enable a simple construction for the contact-making of the insulation displacement contact with a base contact.

Figure 2:
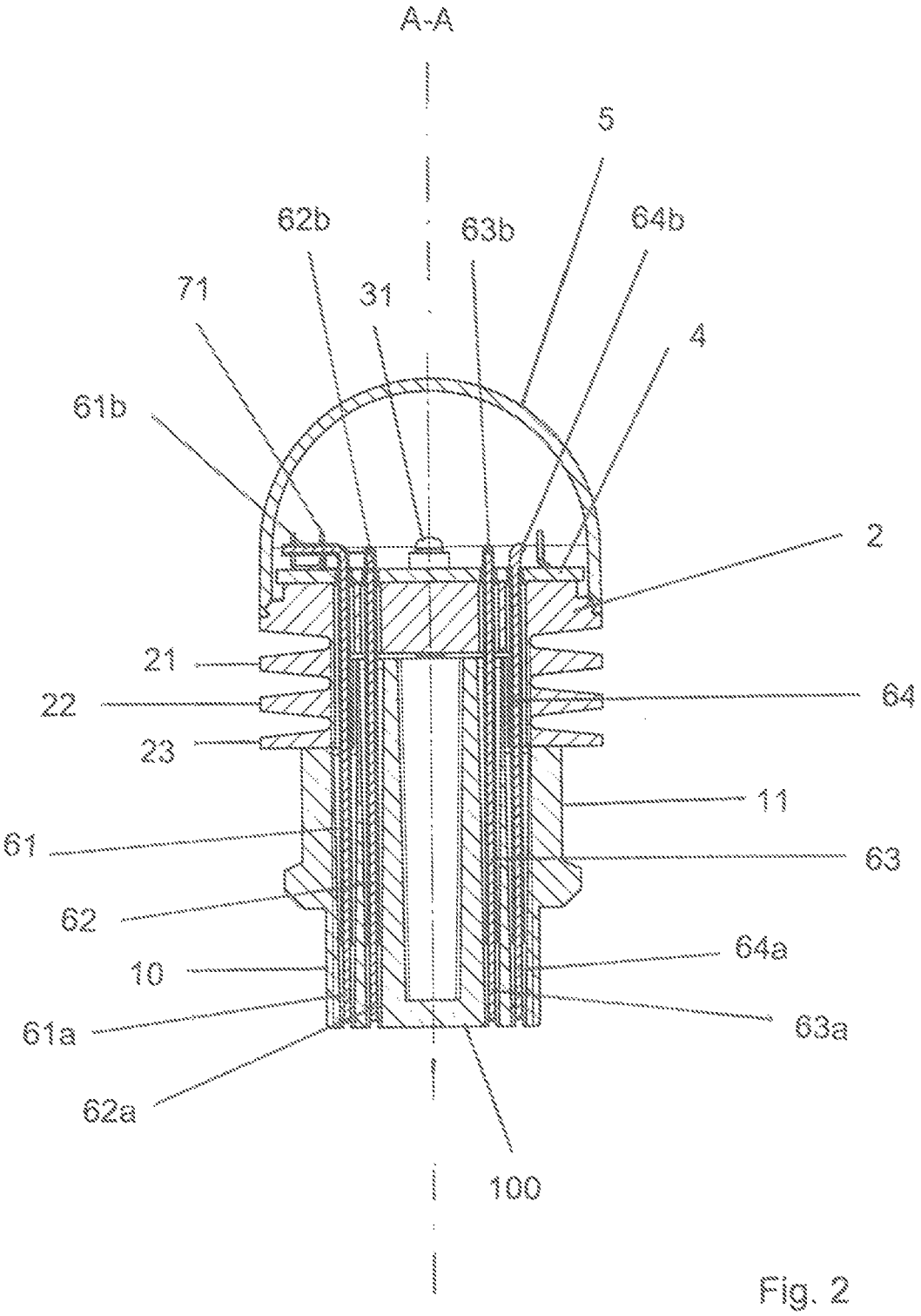
FIG. 2 shows a longitudinal section through the lamp depicted in FIG. 1.
Figure 3:
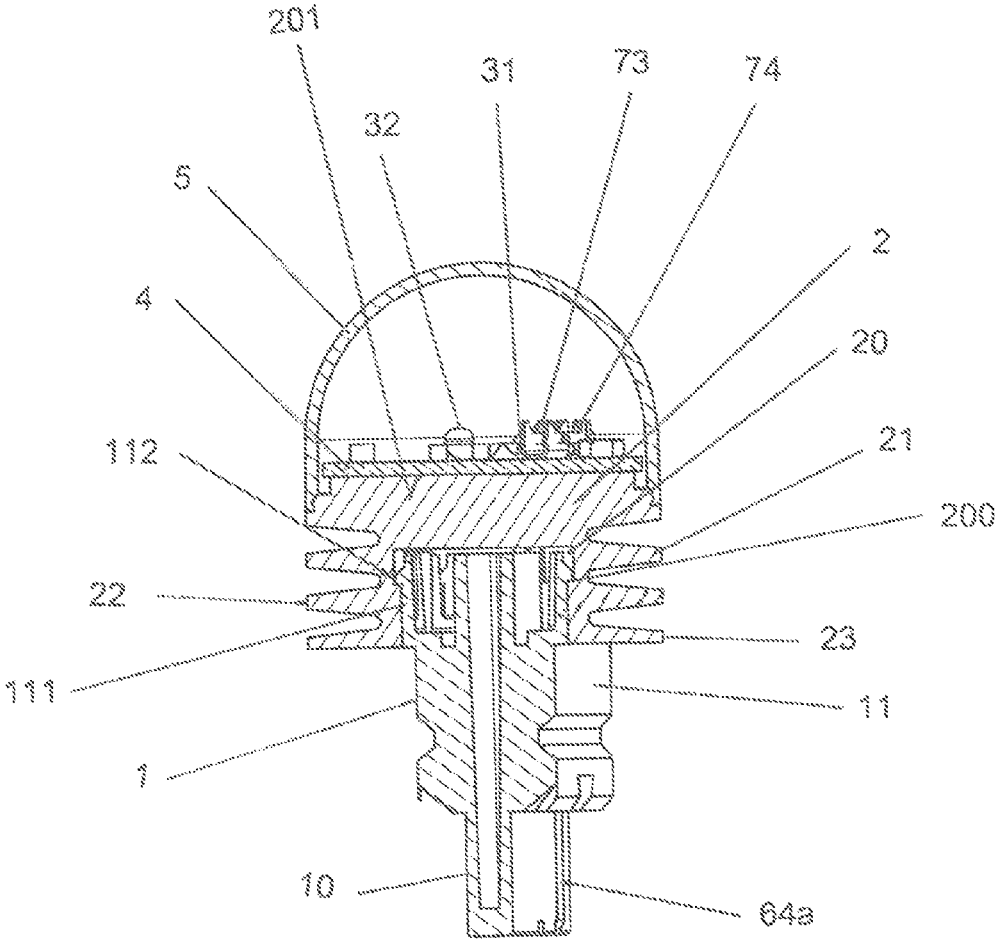
FIG. 3 shows a further longitudinal section through the lamp depicted in FIG. 1 with a section plane which forms an angle of 54 degrees with the section plane illustrated in FIG. 2.

The lamp depicted in FIG. 1 to FIG. 3 in accordance with various embodiments has a base 1 consisting of plastic which is compatible with a standardized base in the IEC category W2.5×16, a metal heat sink 2, two semiconductor light source arrangements 31, 32, which are arranged together with components of an operating device for the semiconductor light source arrangement 3 on a mounting board 4, and a transparent optical element 5. This lamp is intended for use in a motor vehicle as a brake light, a taillight, a daytime running light, position light, reversing light, flashing light and combinations of these applications.

The base 1 is equipped with four base contacts 61, 62, 63, 64, which are each formed by a power supply wire. The power supply wires 61, 62, 63, 64 each run in an appropriately sized guide groove in a web-shaped end section 10 of the base 1 and their first end is bent back in each case through an angle of 90 degrees at an edge of an end face 100 of the web-shaped end section 10 of the base. In each case two 61, 63 of the four power supply wires 61, 62, 63, 64 run in guide grooves in the same side wall 101 of the end section 10 of the base 1, while the other two power supply wires 62, 64 are arranged in guide grooves in an opposite side wall 102 of the end section 10 of the base.

In addition, the base 1 has a second base section 11, which is integrally formed on the end section 10 and on which the heat sink 2 is fixed by a latching connection. The second base section 11, for this purpose, has two spring lugs 111, which are provided with hooks 112 and which latch in during fitting in a ring-shaped groove 200 in the heat sink 2. The second base section 11 furthermore has two pins (not depicted), which each engage in an appropriately sized bore (not depicted) in the heat sink 2 and prevent a rotary movement of the heat sink 2 about the longitudinal axis A-A of the lamp and relative to the base 1.

The heat sink 2 consists of an electrically conductive and thermally conductive material, e.g. of metal such as, for example, aluminum or copper, and is rotationally symmetrical with respect to the longitudinal axis A-A of the lamp. It has three cooling ribs 21, 22, 23, which each protrude radially from the outer surface of the heat sink 2 and run in the form of a ring around the heat sink 2. The heat sink 2 has a cylindrical cavity 20, whose cylinder axis coincides with the lamp longitudinal axis A-A, and a ring-shaped groove 200 is arranged on the inner wall of said cavity. The second base section 11 of the base 1 engages in the cavity 20 so that the hooks 112 of the spring lugs 111 latch into the groove 200. The heat sink 2 has a resting surface 201, which is arranged perpendicularly to the lamp longitudinal axis A-A and on which the mounting board 4 rests.

The mounting board 4 extends perpendicularly to the lamp longitudinal axis A-A and is fixed on the resting surface 201 of the heat sink 2. Two semiconductor light source arrangements 31, 32 are fitted and four insulation displacement contacts 71, 72, 73, 74 are arranged on that surface of the mounting board 4 which is remote from the heat sink 2. The insulation displacement contacts 71, 72, 73, 74 make contact with and fix in each case the second bent-back end 61*b*, 62*b*, 63*b*, 64*b* of a power supply wire 61, 62, 63, 64 on the mounting board 4. The four power supply wires 61, 62, 63, 64 each have an electrically insulating sheath or sleeving. The insulation displacement contacts 71, 72, 73, 74 consist of metal and in each case cut into the insulating sheath of the corresponding power supply wire 61, 62, 63, 64, with the result that they make contact in each case between the second end 61*b*, 62*b*, 63*b*, 64*b* of the corresponding power supply wire 61, 62, 63, 64, via a contact face or a conductor track on the mounting board 4, and the semiconductor light source arrangements 31, 32 or the electrical components of the operating device for the semiconductor light source arrangements 31, 32. The section 61*a*, 62*a*, 63*a*, 64*a* of the power supply wires 61, 62, 63, 64 which is arranged in each case in a guide groove in the web-shaped end section 10 of the base 1 and the bent-back second end of the power supply wires 61, 62, 63, 64 are each formed without an electrically insulating sheath or sleeving. These sections 61*a*, 62*a*, 63*a*, 64*a* of the power supply wires 61, 62, 63, 64 act as base contacts of the lamp. In various embodiments, the power supply wires 61, 64 are used for making contact with the first semiconductor light source arrangement 31, and the power supply wires 62, 63 are used for making contact with the second semiconductor light source arrangement 32. The power supply wires 61, 62, 63, 64 are each passed through an aperture in the mounting board 4, the heat sink 2 and the base 1.

The semiconductor light source arrangement 31, 32 each consist of a light-emitting diode 31, 32, which are arranged on the mounting board 4, and emit red light during operation. The first light-emitting diode 31 is used for generating a rear light or a taillight for the motor vehicle, and the second light-emitting diode 32, together with the first light-emitting diode 31, is used for generating the brake light of the motor vehicle. The operating device for the light-emitting diodes 31, 32 includes the components of driver circuits (not depicted) for the light-emitting diodes 31, 32 and a bridge rectifier (not depicted) as protection for the lamp so as to prevent it from being inserted into a lampholder with base contacts of incorrect polarity. Owing to the use of the bridge rectifier, it makes no difference which base contact 61*a* or 64*a* and 62*a* or 63*a* is connected to the positive or negative terminal of the motor vehicle electrical distribution system voltage.

The optical element 5 is transparent, consists of plastic or glass and is in the form of a hemispherical hood, which covers the mounting board 4 and the semiconductor light source arrangement 31, 32 mounted thereon and the insulation displacement contacts 71, 72, 73, 74. The material of the optical element 5 is in addition colorless and light-scattering.

Alternatively, the optical element 5 can also be in the form of a red color filter, which is only transparent to red light, and the semiconductor light source arrangement 31, 32 can be in the form of light-emitting diodes emitting white light in order to provide a lamp which generates red light and is suitable as a light source for a brake light or taillight.

In addition, as a further alternative, the optical element 5 can also be formed without a color filter and without light-scattering means, and the semiconductor light source arrangement 31, 32 can be in the form of light-emitting diodes which emit white light. In this case, the lamp can be used as brake light or taillight behind a red cover of the vehicle rear lamps or behind a clear cover as reversing light or daytime running light. The two light-emitting diodes 31, 32 can be operated separately or jointly in order to realize the abovementioned applications. In addition, the two light-emitting diodes 31, 32 can be dimmed, i.e. the brightness of the two light-emitting diodes 31, 32 can be varied in order to switch over from rear light to brake light and vice versa, for example, or in order to switch over from daytime running light to position light, for example, and vice versa.

Figure 4:
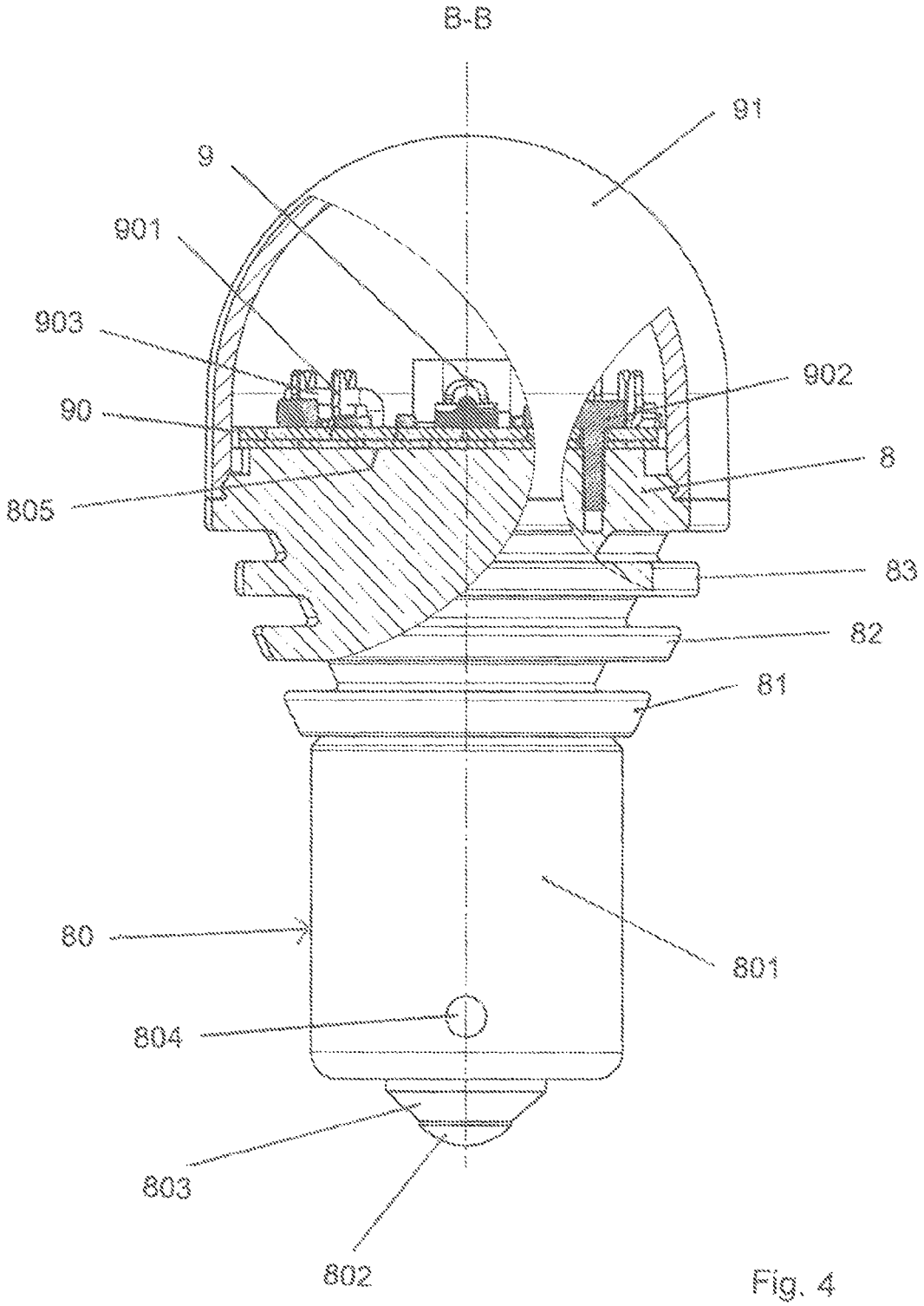
FIG. 4 shows a partially sectioned illustration of a lamp in accordance with various embodiments.

The lamp depicted in FIG. 4 in accordance with various embodiments has a base 80, which is compatible with a standardized base of IEC category from the BA family, for example BAU15s or BA15s etc., a heat sink 8, a semiconductor light source arrangement 9, which is arranged, together with components of an operating device for the semiconductor light source arrangement 9, on a mounting board 90, and a transparent optical element 91. This lamp is intended for use in a motor vehicle as flashing light, for example in a direction indicator.

The base 80 is in the form of a bayonet base and has a metal, cylindrical base sleeve 801, which forms a first base contact for supplying voltage to the semiconductor light source arrangement 9 and the operating device thereof. The cylinder axis of the base sleeve 801 is identical to the longitudinal axis B-B of the lamp. The base sleeve 801 has two diametrically arranged locking knobs 804 on its outer side. In addition, the base 80 has a metal central contact 802, which is insulated from the base sleeve 801 by an insulating body 803 consisting of plastic or ceramic. The central contact 802 is arranged in the longitudinal axis B-B of the lamp, at that end of the base 80 which is remote from the optical element 91.

The heat sink 8 consists of an electrically conductive and thermally conductive material, for example of metal such as, for example, aluminum or copper, and is rotationally symmetrical with respect to the longitudinal axis B-B of the lamp. It has three cooling ribs 81, 82, 83, which each protrude radially from the outer surface of the heat sink 8 and run in the form of a ring around the heat sink 8. The heat sink 8 is fixed on the base sleeve 801 by a latching connection.

The mounting board 90 extends perpendicularly to the lamp longitudinal axis B-B and is fixed on the resting surface 805 of the heat sink 8. The semiconductor light source arrangement 9 and two insulation displacement contacts 901, 902 are arranged on that surface of the mounting board 90 which is remote from the heat sink 8. A first insulation displacement contact 901 cuts into the sleeving-shaped insulation of a power supply wire 903, which is electrically conductively connected to the central contact 802 of the base 80. The power supply wire 903 and the first insulation displacement contact 901 connect the semiconductor light source arrangement 9 or the operating device thereof (not depicted) electrically conductively to the central contact 802. The second insulation displacement contact 902 is in the form of a self-tapping, metal screw 902, which protrudes through the mounting board 90 into an appropriately sized screw thread in the metal heat sink 8. The screw 902 produces an electrically conductive connection between a contact face or a conductor track on the mounting board 90 and the heat sink 8. Since the heat sink 8 for its part is connected to the base sleeve 801, as a result an electrically conductive connection is produced between the contact face arranged on the mounting board 90 or the conductor track and the base sleeve 801 by means of the self-tapping metal screw 902. The abovementioned contact face or conductor track is connected to the semiconductor light source arrangement 9 or the operating device thereof. The first insulation displacement contact 901, which is connected to the central contact 802 via the power supply wire 903, and the self-tapping screw 902, which is connected to the base sleeve 801 via the heat sink 8, make contact between the semiconductor light source arrangement 9 or the operating device thereof, and the electrical base contacts 801, 802 of the lamp.

The semiconductor light source arrangement 9 consists of a light-emitting diode 9, which is arranged on the mounting board 90 and emits orange light during operation. The light-emitting diode 9 is used for generating a flashing light for the direction indicator or flashing hazard light of a motor vehicle. The operating device for the light-emitting diode 9 includes the components of a driver circuit (not depicted) for the light-emitting diode 9.

The optical element 91 is transparent, consists of plastic or glass and is in the form of a hemispherical hood, which covers the mounting board 90 and the semiconductor light source arrangement 9 mounted thereon and the insulation displacement contacts 901, 902. The material of the optical element 91 is additionally colorless and light-scattering.

Alternatively, the optical element 91 can also be in the form of an orange color filter or an orange cover, and the semiconductor light source arrangement 9 can be in the form of a light-emitting diode emitting white light in order to produce a lamp which generates orange light and is suitable as a light source for a flashing light in a direction indicator or a flashing hazard light of the motor vehicle.

In addition, as a further alternative, the optical element 91 can also be formed without a color filter and without color-scattering means, and the semiconductor light source arrangement 9 can be in the form of a light-emitting diode emitting white light. In this case, the lamp can be used as a flashing light behind an orange cover of a direction indicator of the vehicle or behind a colorless, clear cover of a vehicle rear headlamp as a reversing light, daytime running light and position light or can be used behind a red cover as taillight and brake light.

The invention is not restricted to the exemplary embodiments of the invention explained in more detail above. For example, the lamp in accordance with the various embodiments as shown in FIG. 1 can also have only one semiconductor light source arrangement instead of two semiconductor light source arrangements and correspondingly can have only two base contacts instead of four base contacts. The semiconductor light source arrangements do not necessarily need to be in the form of individual light-emitting diodes or in the form of light-emitting diode chips, but can also be in the form of light-emitting diode arrays or laser diodes.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A lamp, comprising:

a mounting board;

at least one semiconductor light source arrangement arranged on the mounting board and comprising a base, which is provided with base contacts for supplying energy to the at least one semiconductor light source arrangement and which is compatible with a standardized incandescent lamp base;

at least one insulation displacement contact to make electrical contact with the at least one semiconductor light source arrangement, wherein the at least one insulation displacement contact is in the form of a self-tapping metal screw or an electrically conductive rivet, and wherein the self-tapping screw or the self-tapping rivet protrudes through the mounting board into a metal heat sink.

2. The lamp of claim 1, wherein the at least one insulation displacement contact is arranged on the mounting board.

3. The lamp of claim 1, wherein at least one base contact is connected to the at least one insulation displacement contact by a power supply wire.

4. The lamp of claim 1, wherein a power supply wire section, which is arranged at a first end of the power supply wire, forms the base contact, and contact is made with a second end of the power supply wire by the insulation displacement contact on the mounting board.

5. The lamp of claim 1, wherein the mounting board rests on a heat sink.

6. The lamp of claim 5, wherein the heat sink is fixed on the base.

7. The lamp of claim 6, wherein the heat sink and the base have leadthroughs for at least one power supply wire.

8. The lamp of claim 1, wherein the metal heat sink is electrically conductively connected to a base contact of the lamp.

* * * * *